US006174296B1

(12) United States Patent
Wang

(10) Patent No.: US 6,174,296 B1
(45) Date of Patent: Jan. 16, 2001

(54) AUTOMATIC BACK RUBBING ASSEMBLY

(76) Inventor: Ming-Cheng Wang, 58, Ma Yuan West St., Taichung (TW)

( * ) Notice: Under 35 U.S.C. 154(b), the term of this patent shall be extended for 0 days.

(21) Appl. No.: 09/332,387

(22) Filed: Jun. 14, 1999

(51) Int. Cl.[7] ..... A61H 15/00

(52) U.S. Cl. ..... 601/114; 601/112; 601/154; 601/159; 4/606

(58) Field of Search ..... 601/129, 130, 601/136, 154, 155, 156, 158, 159, 160, 167, 169, 112, 114, 126, 17; 4/628, 596, 597, 606; 15/21.1, 22.1

(56) References Cited

U.S. PATENT DOCUMENTS 2,730,737 * 1/1956 Herman ..... 601/114
3,209,372 * 10/1965 Boyett, Sr. et al. ..... 601/154
3,380,080 * 4/1968 Farrell ..... 601/154
3,641,996 * 2/1972 Friend ..... 601/156
3,768,462 * 10/1973 Boulard ..... 601/112
3,875,604 * 4/1975 Wurn et al. ..... 601/114
4,040,132 * 8/1977 Braun ..... 601/112
4,356,583 * 11/1982 Wallasch et al. ..... 601/114
4,526,163 * 7/1985 Fedders ..... 601/112
4,633,857 * 1/1987 Czeczerski ..... 601/114
4,817,227 * 4/1989 Scott ..... 601/114

* cited by examiner

*Primary Examiner*—Justine R. Yu

(57) ABSTRACT

An automatic back rubbing assembly has a hollow casing, a water control unit disposed in the hollow casing, a bubble producer disposed in the hollow casing, an elevator box disposed on a bottom of the hollow casing, a rubbing device disposed in the elevator box, an elevator drive mechanism driving the elevator box to move upward and downward, and a back rubbing drive mechanism driving the rubbing device to rotate.

3 Claims, 12 Drawing Sheets

AUTOMATIC BACK RUBBING ASSEMBLY

BACKGROUND OF THE INVENTION

The present invention relates to an automatic back rubbing assembly. More particularly, the present invention relates to an automatic back rubbing assembly which can rub a back of a user automatically.

It is difficult to rub a back with two hands. Most old people cannot lift their hands to reach their backs. Therefore, the backs of the old people cannot be rubbed and cleaned.

SUMMARY OF THE INVENTION

An object of the present invention is to provide an automatic back rubbing assembly which can rub a back of a user upward and downward.

Another object of the present invention is to provide an automatic back rubbing assembly which has an adjustment device to adjust a height of a seating panel.

Accordingly, an automatic back rubbing assembly comprises a hollow casing, a water control unit, a bubble producer, an elevator drive mechanism, an elevator box, a back rubbing drive mechanism, and a rubbing device. The bubble producer is disposed in the hollow casing. The water control unit is disposed in the hollow casing. The water control unit has a liquid soap tank, a joint connected to a bubble producing device, a first valve, and a second valve, a first connection pipe connected to the liquid soap tank and the first valve, a second connection pipe connected to the second valve and a third valve, a water outlet tube connected to the third valve, a third connection pipe connected to the third valve and a fourth valve, and a water outlet pipe connected to the fourth valve and a shower nozzle. An water inlet pipe is connected to the third valve. The water outlet tube has a water outlet. The bubble producer has a positioning seat disposed in a lower interior of the hollow casing, a slot formed on a top portion of the positioning seat, a first motor disposed on the positioning seat, an outer box disposed in the positioning seat, an inner box enclosed by the outer box, a positioning plate disposed in the positioning seat, an eccentric wheel disposed between the positioning seat and the inner box, and a ratchet disposed in the inner box. The first motor has a first shaft inserted through the eccentric wheel and the ratchet. The positioning plate has a recess receiving the eccentric wheel, and two oblong grooves. The outer box has two oblong holes matching the oblong grooves, an upper flange having a through hole receiving the joint, and four slide grooves. The inner box has four slide rails inserted in the slide grooves, a rectangular groove, a through aperture matching the through hole, and a liquid outlet. A cover plate engages with the outer box. The elevator box is disposed on a bottom of the hollow casing. A base seat is disposed in a rear portion of the elevator box. A main seat is disposed in a front portion of the elevator box. The main seat has a hollow housing, and two circular holes receiving a first threaded sleeve and a second threaded sleeve. The hollow housing has a center hole, two inner grooves, and a hollow chamber. A cover panel covers the main seat. The cover panel has an opening receiving an annular seat. Two longitudinal posts pass through the rear portion of the elevator box. An upper end of each longitudinal post is inserted in a bottom of the hollow casing. A first hollow screw rod is inserted through the first threaded sleeve. A first longitudinal pivot is inserted through the first hollow screw rod. The first hollow screw rod has a first outer thread. The first threaded sleeve has a first inner thread. The first outer thread engages with the first inner thread. A second hollow screw rod is inserted through the second threaded sleeve. A second longitudinal pivot is inserted through the second hollow screw rod. The second hollow screw rod has a second outer thread. The second threaded sleeve has a second inner thread. The second outer thread engages with the second inner thread. An upper end of the first longitudinal pivot is inserted in the bottom of the hollow casing. An upper end of the second longitudinal pivot is inserted in the bottom of the hollow casing. The elevator drive mechanism drives the elevator box to move upward and downward. The elevator drive mechanism has the first longitudinal pivot, a second motor having a second shaft inserted in a first drive gear, a first follower gear engaging with the first drive gear, a first driven gear engaging with the first follower gear, and the first driven gear disposed on a top end of the first longitudinal pivot. The back rubbing drive mechanism drives the rubbing device to rotate. The back rubbing drive mechanism has the second longitudinal pivot, a third motor having a third shaft inserted in a second drive gear, a second follower gear engaging with the second drive gear, a second driven gear engaging with the second follower gear, and the second driven gear disposed on a top end of the second longitudinal pivot. The rubbing device is disposed in the elevator box. The rubbing device has two driven pinions, two gear wheels engaging with the second hollow screw rod, two follower shafts connected to the respective driven pinion and the respective gear wheel, two positioning racks disposed on the base seat to support the follower shafts, a rotor device having a threaded portion inserted through the center hole of the hollow housing, a catch ring, two catch blocks, two compression springs, and a push device. The catch ring, the catch blocks, the compression springs, and the push device are disposed in the hollow chamber. The push device is clamped by the catch blocks. Each catch block has an insertion groove. An annular seat is disposed on the rotor device. A foamed pad is inserted in the annular seat. The threaded portion of the rotor device engages with the respective driven pinion.

DETAILED DESCRIPTION OF THE INVENTION

Figure 1:
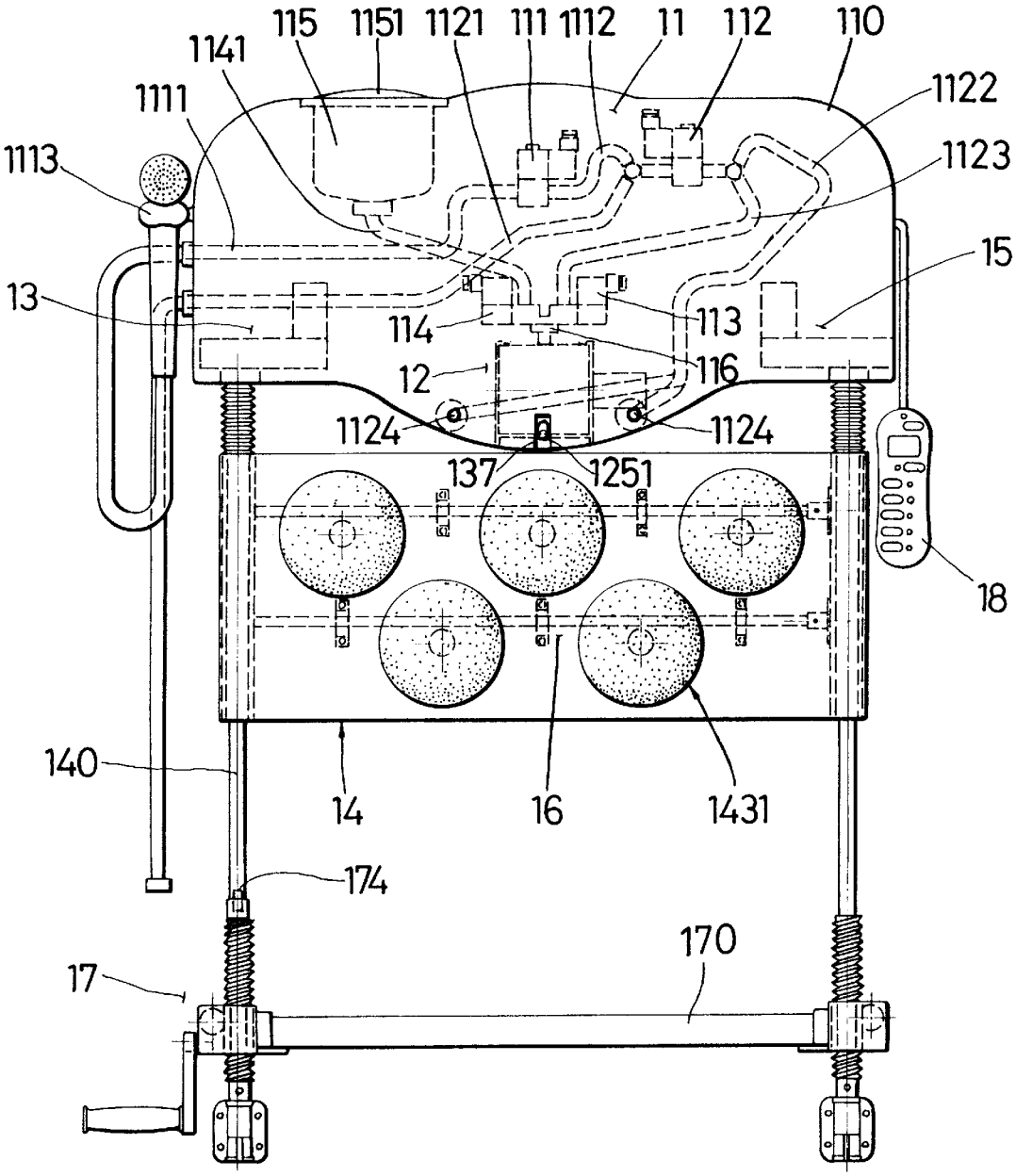
FIG. 1 is a front elevational view of an automatic back rubbing assembly of a preferred embodiment in accordance with the present invention.
Figure 2:
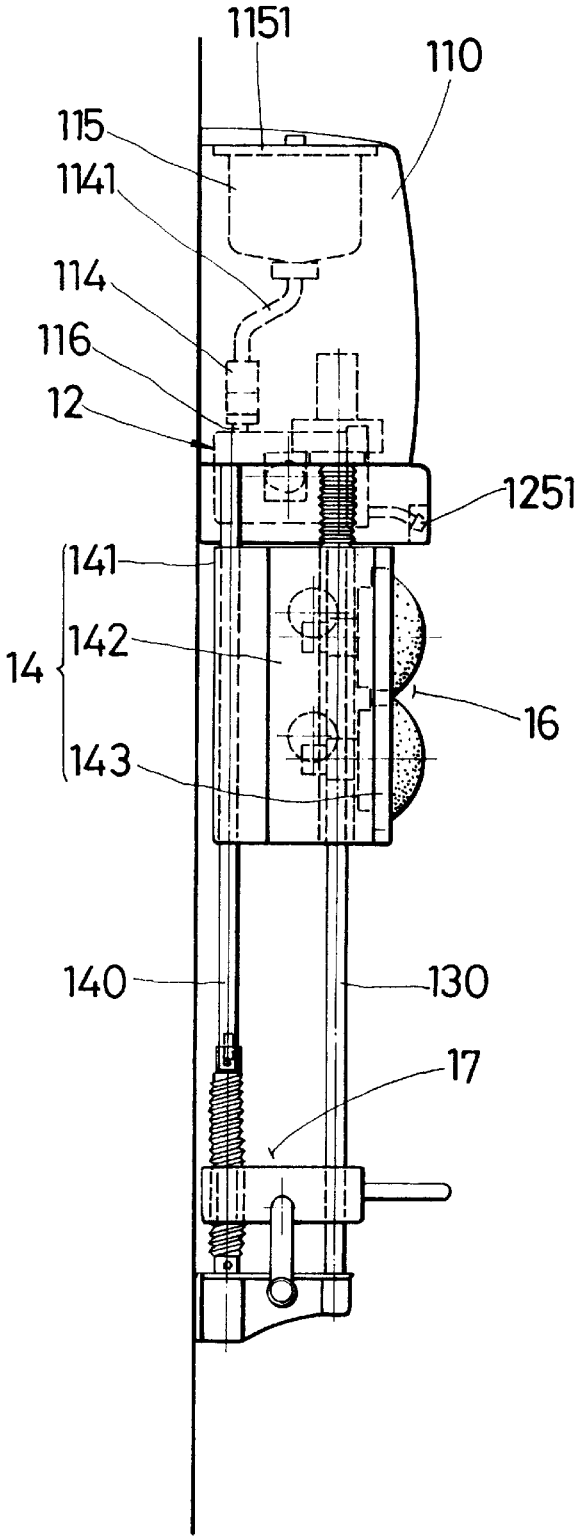
FIG. 2 is a side elevational view of an automatic back rubbing assembly of a preferred embodiment in accordance with the present invention.
Figure 3:
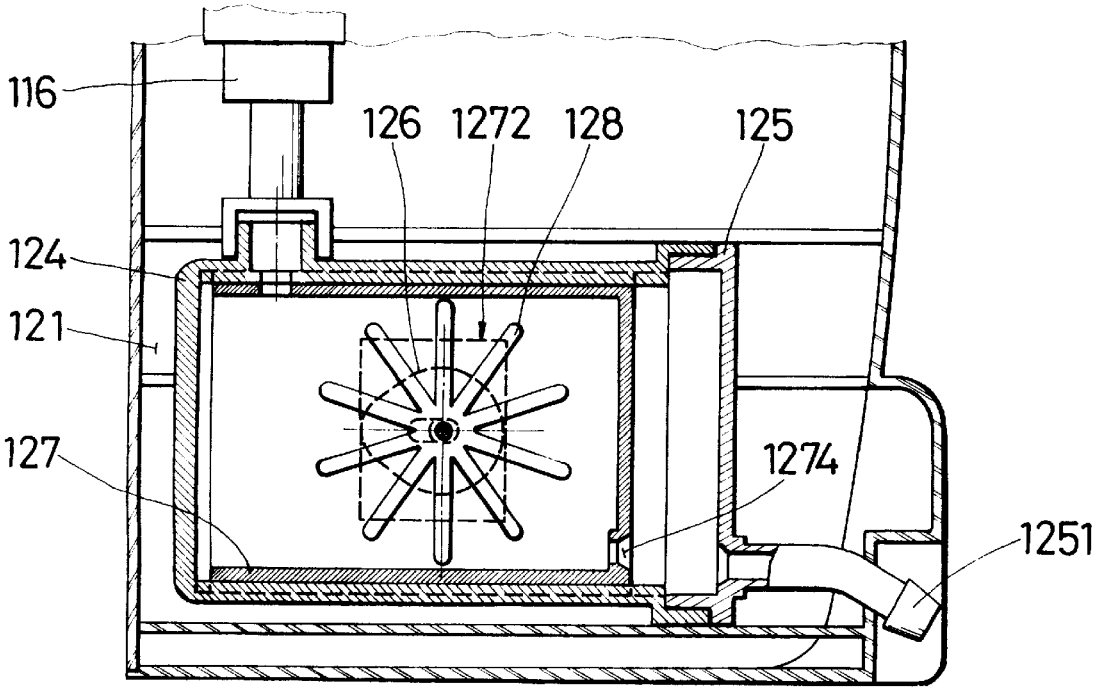
FIG. 3 is a sectional view of a bubble producer of a preferred embodiment in accordance with the present invention.
Figure 4:
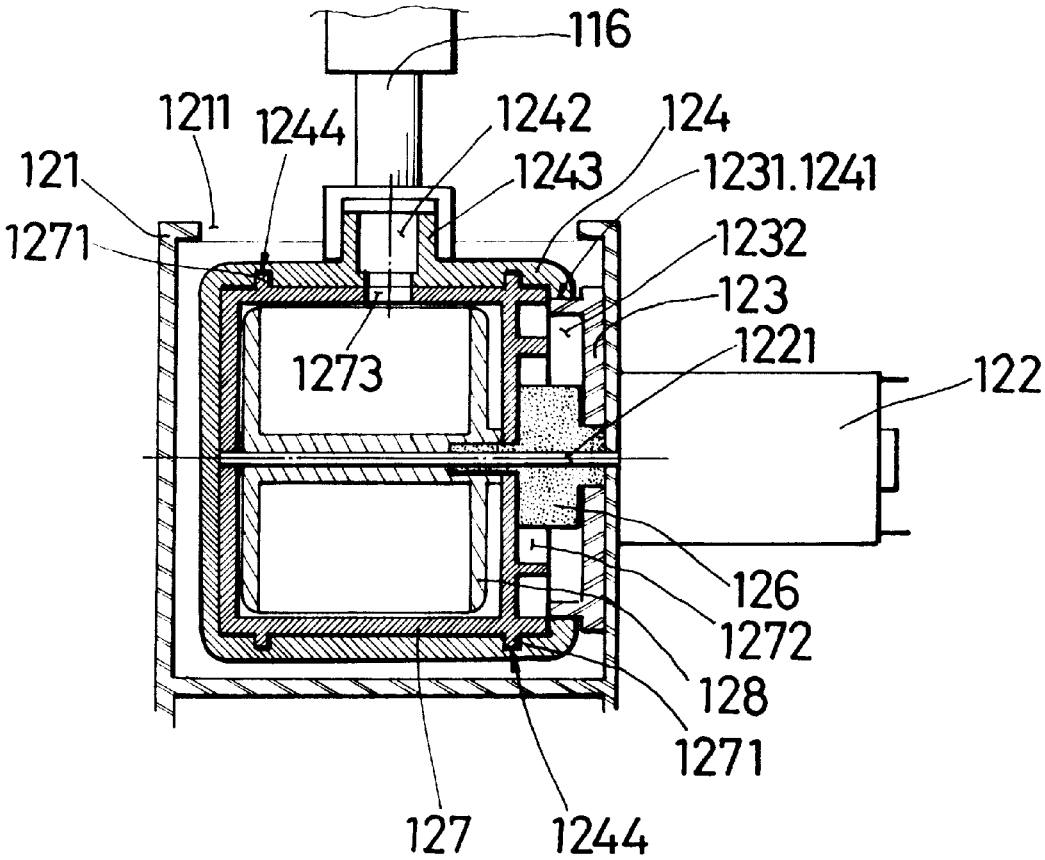
FIG. 4 is another sectional view of a bubble producer of a preferred embodiment in accordance with the present invention.
Figure 5:
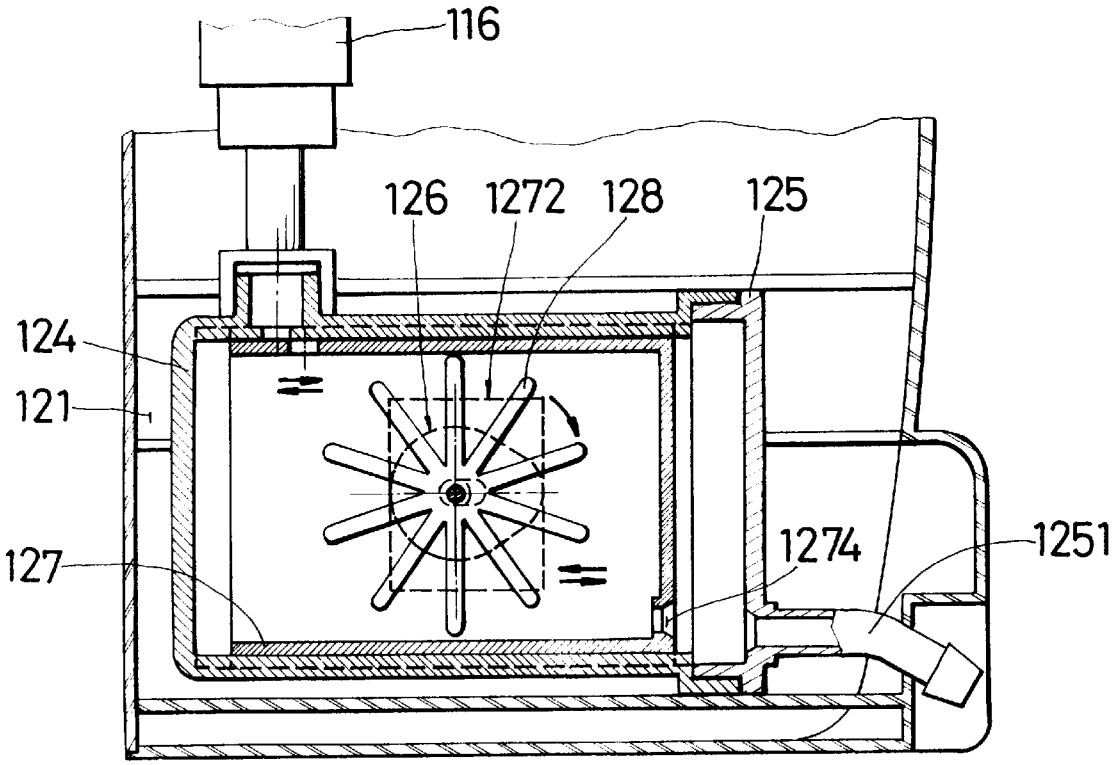
FIG. 5 is a schematic view illustrating an operation of a bubble producer of a preferred embodiment in accordance with the present invention.
Figure 6:
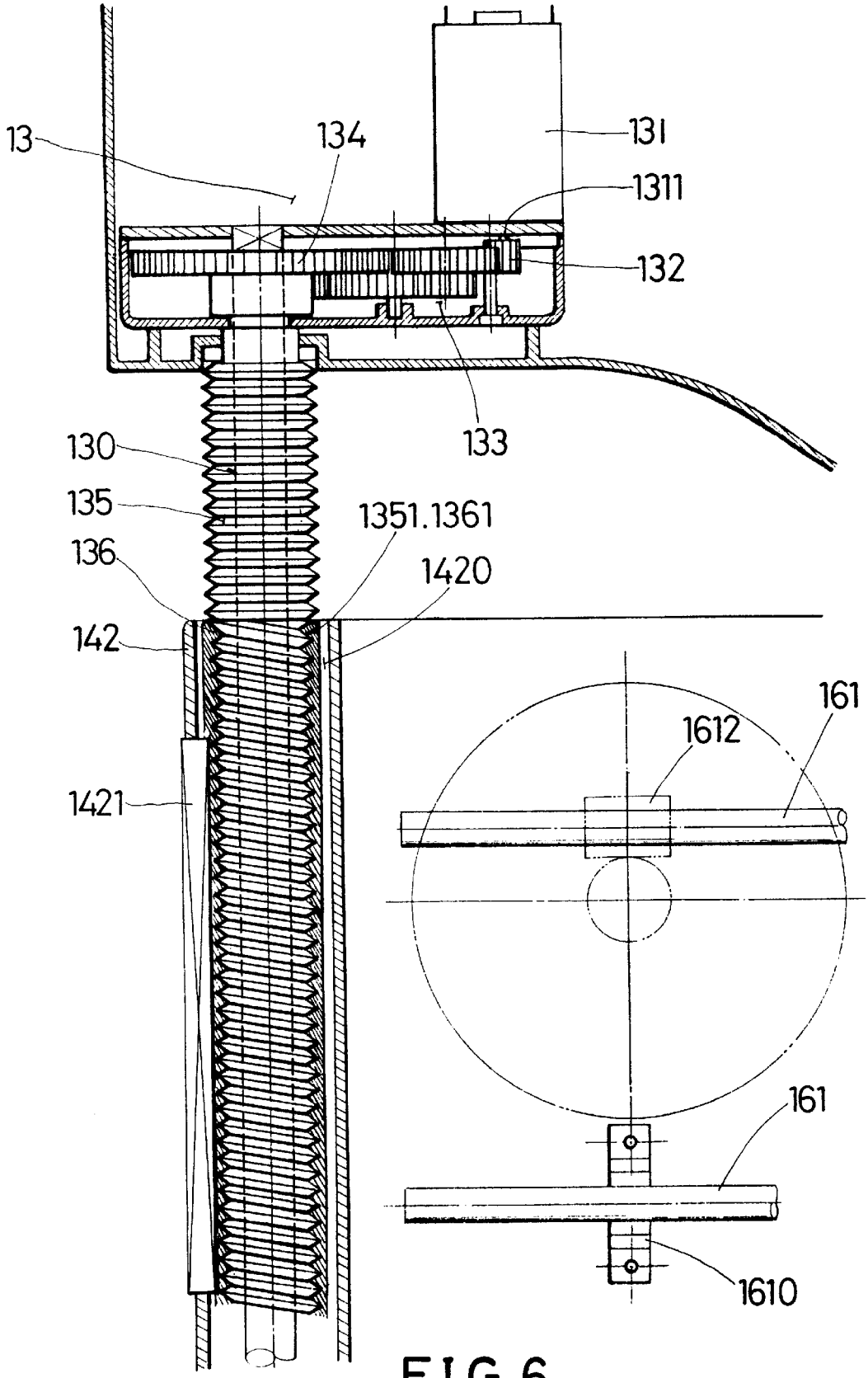
FIG. 6 is a partially sectional view of an elevator drive mechanism of a preferred embodiment in accordance with the present invention.
Figure 7:
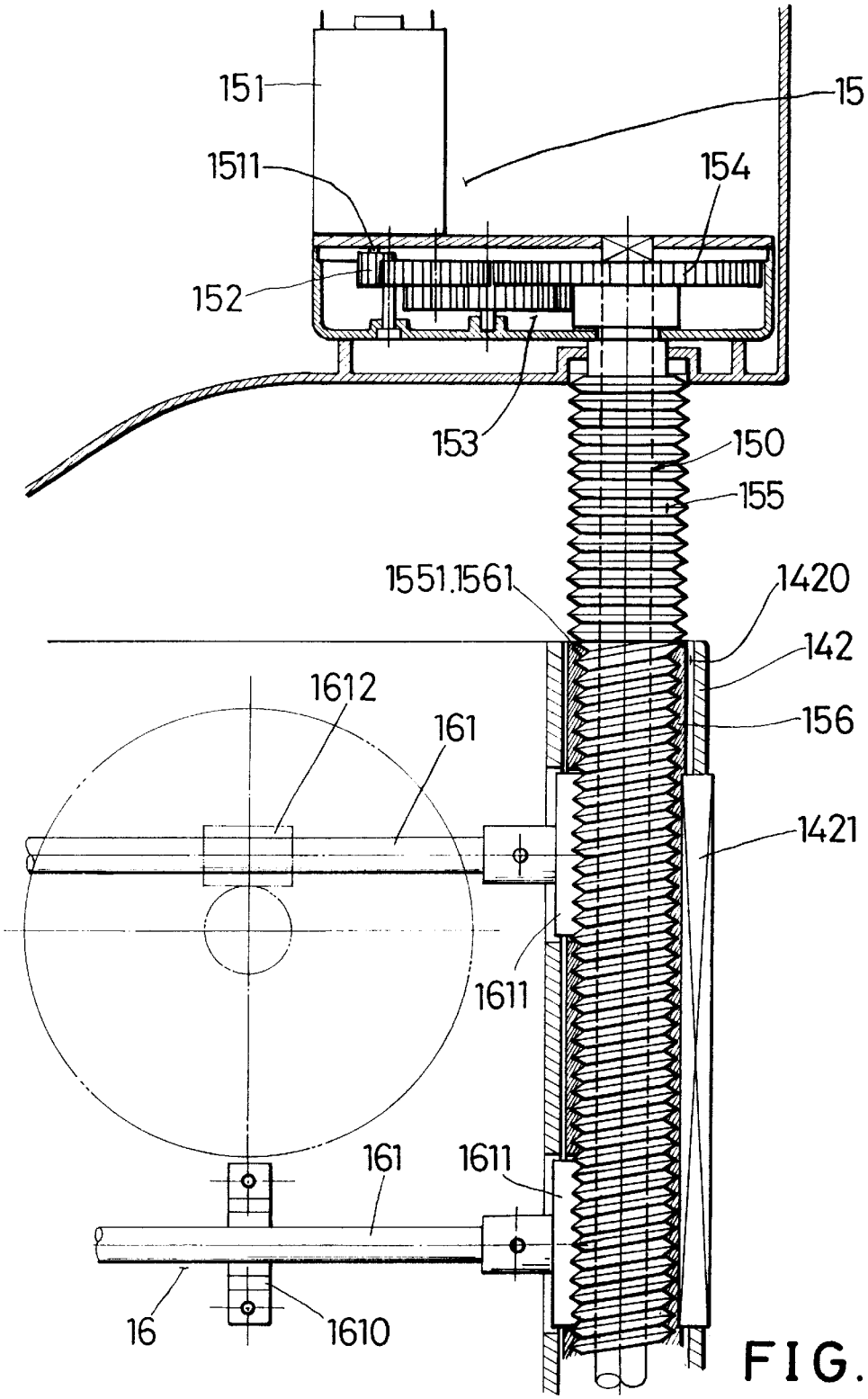
FIG. 7 is a partially sectional view of a back rubbing drive mechanism of a preferred embodiment in accordance with the present invention.
Figure 8:
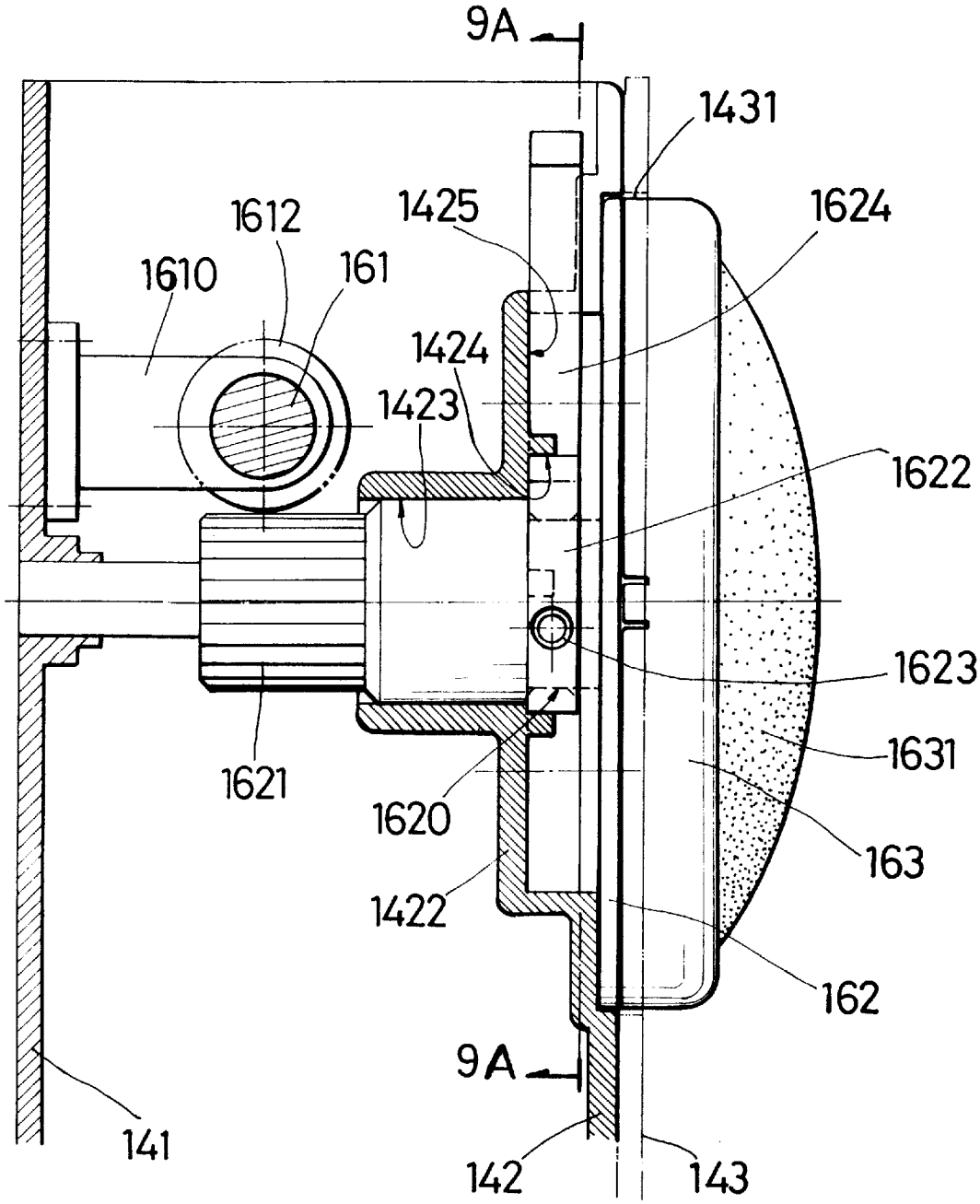
FIG. 8 is a partially sectional view of a rubbing device of a preferred embodiment in accordance with the present invention.
Figure 9:
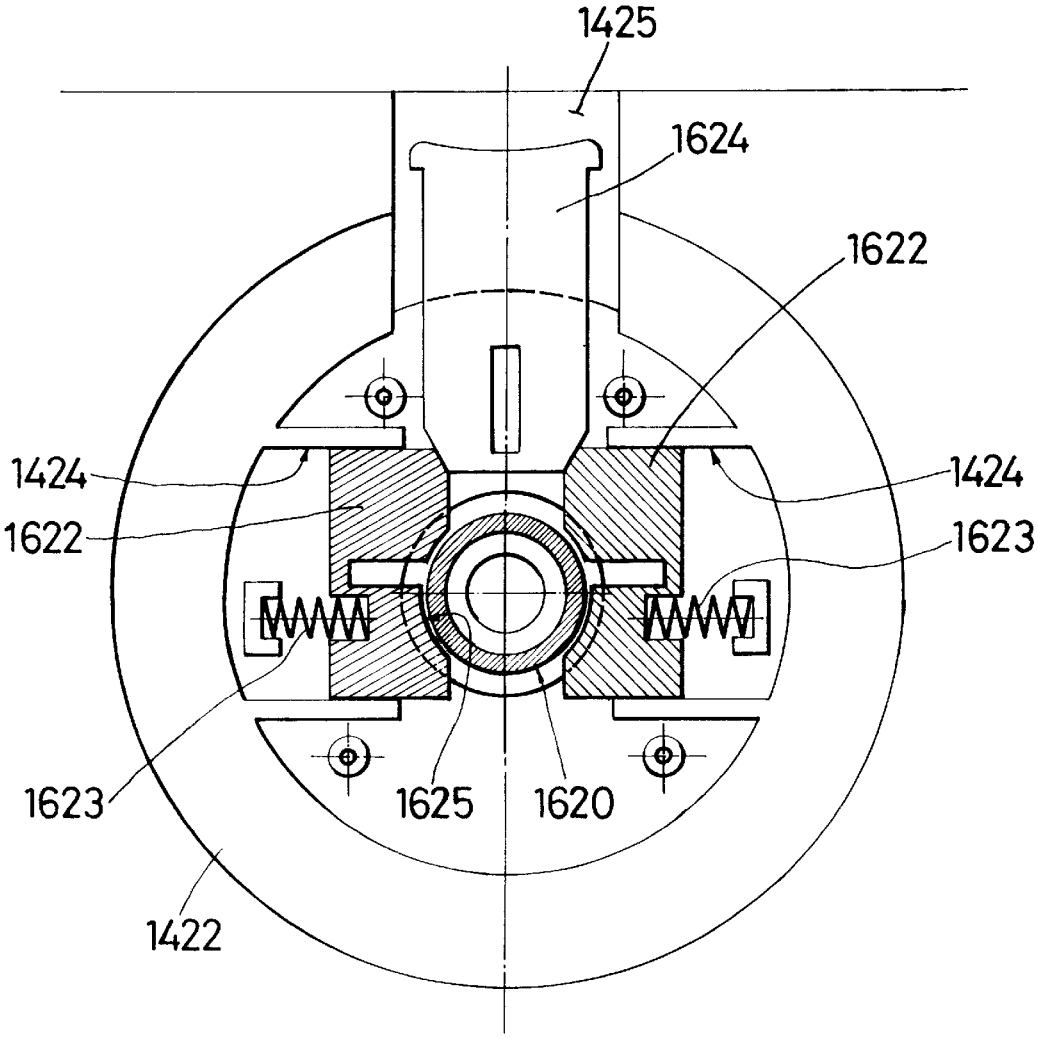
FIG. 9 is another partially sectional view of a rubbing device of a preferred embodiment in accordance with the present invention.
Figure 10:
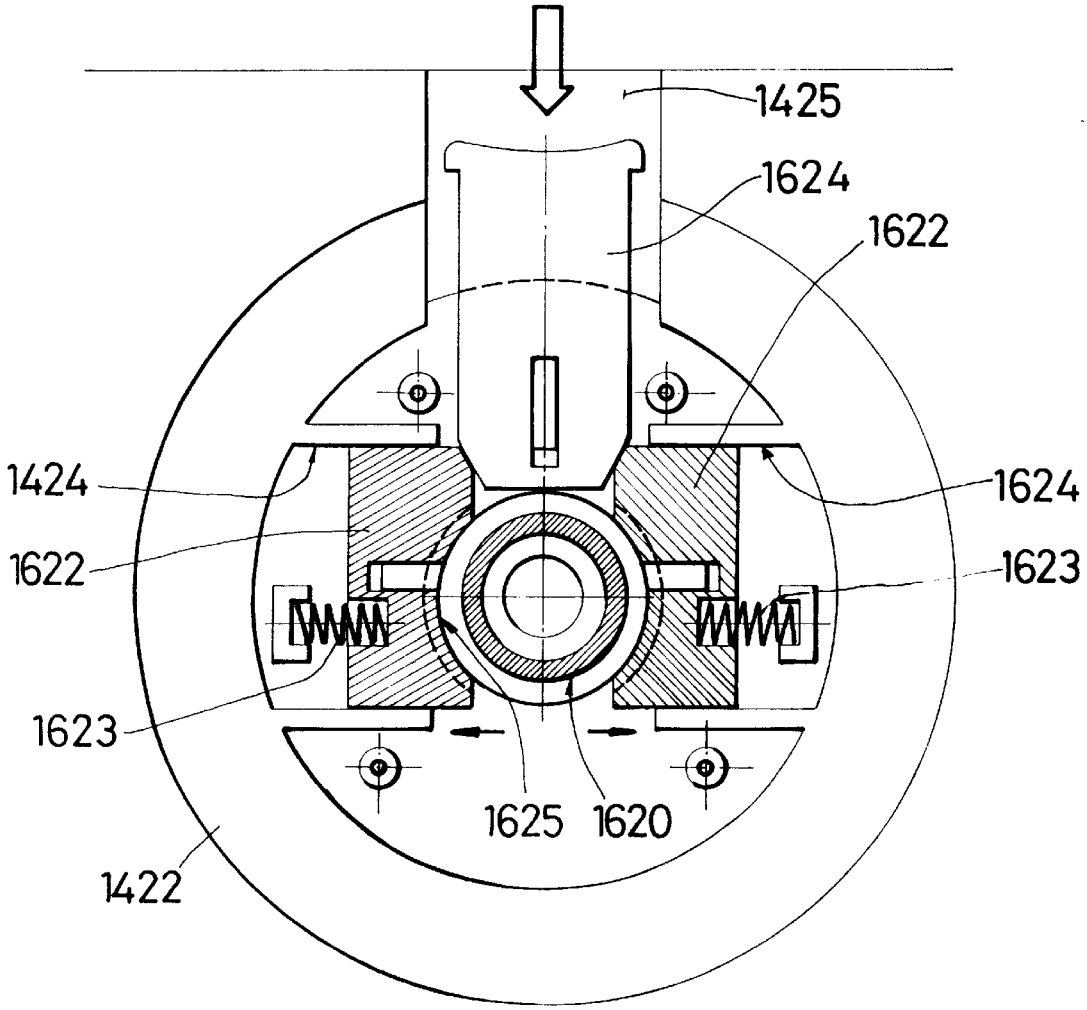
FIG. 10 is a schematic view illustrating an operation of a rubbing device of a preferred embodiment in accordance with the present invention.
Figure 11:
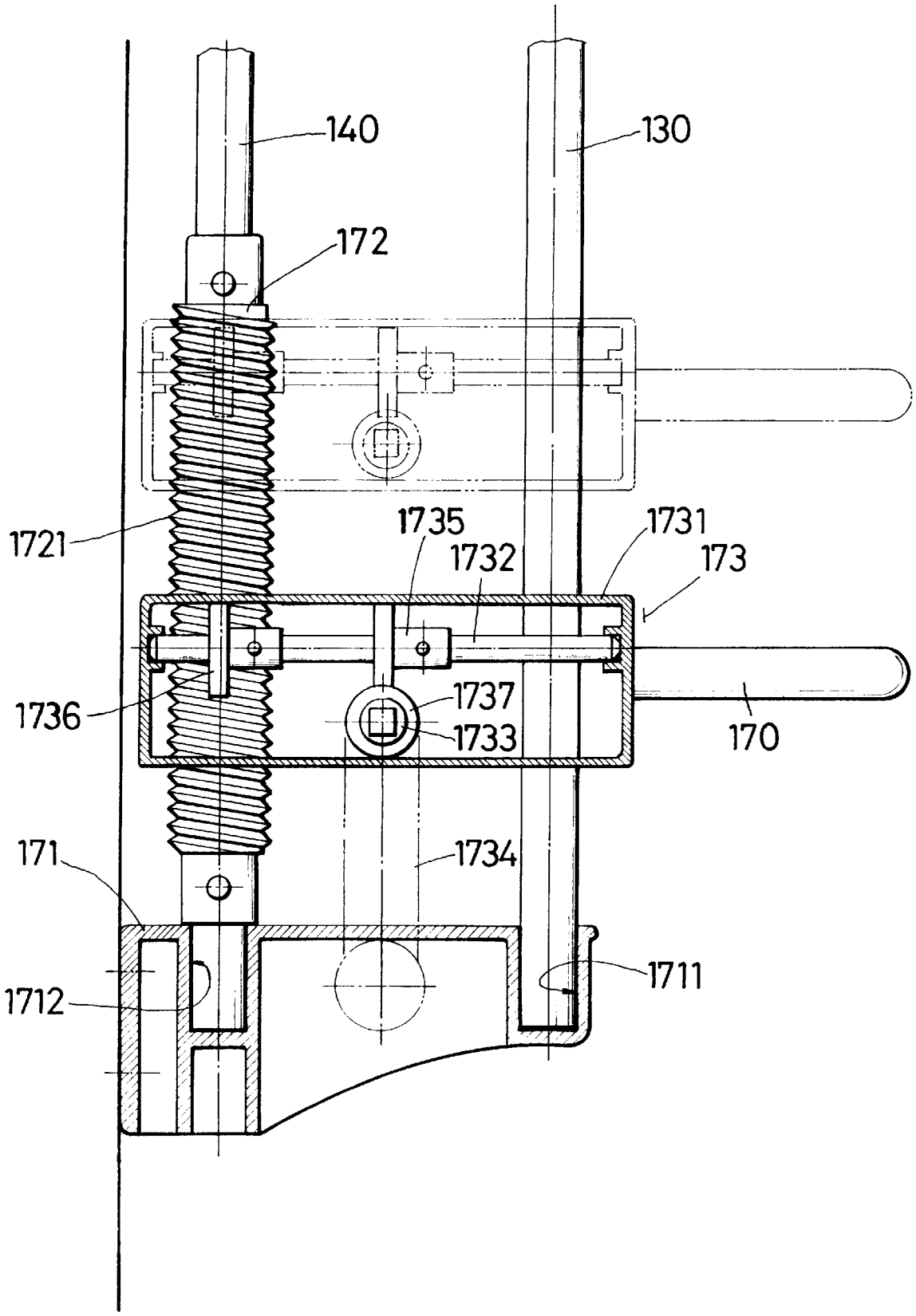
FIG. 11 is a partially sectional view of an adjustment device of a preferred embodiment in accordance with the present invention.
Figure 12:
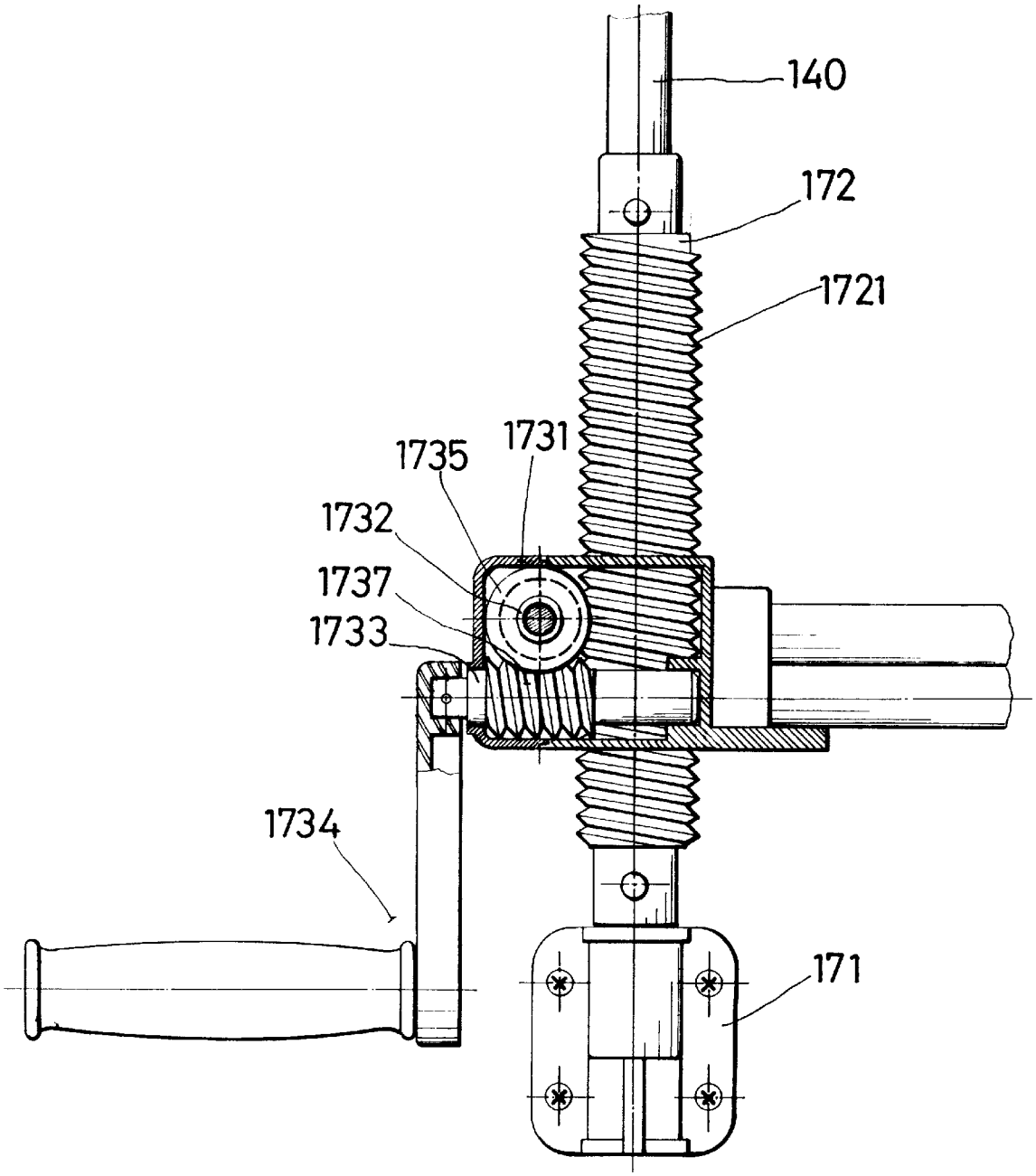
FIG. 12 is a front elevational view of an adjustment device of a preferred embodiment in accordance with the present invention.

Referring to FIGS. 1 to 12, an automatic back rubbing assembly comprises a hollow casing 110, a water control unit 11, a bubble producer 12, an elevator drive mechanism 13, an elevator box 14, a back rubbing drive mechanism 15, a rubbing device 16, an adjustment device 17, and a controller 18.

The bubble producer 12 is disposed in the hollow casing 110.

The water control unit 11 is disposed in the hollow casing 110. The water control unit 11 has a liquid soap tank 115, a joint 116 connected to the bubble producer 12, a first valve 114, and a second valve 113, a first connection pipe 1141 connected to the liquid soap tank 115 and the first valve 114, a second connection pipe 1123 connected to the second valve 113 and a third valve 112, a water outlet tube 1122 connected to the third valve 112, a third connection pipe 1112 connected to the third valve 112 and a fourth valve 111, and a water outlet pipe 1111 connected to the fourth valve 111 and a shower nozzle 1113. An water inlet pipe 1121 is connected to the third valve 112.

The water outlet tube 1122 has a water outlet 1124. An upper cover 1151 covers the liquid soap tank 115.

The bubble producer 12 has a positioning seat 121 disposed in a lower interior of the hollow casing 110, a slot 1211 formed on a top portion of the positioning seat 121, a first motor 122 disposed on the positioning seat 121, an outer box 124 disposed in the positioning seat 121, an inner box 127 enclosed by the outer box 124, a positioning plate 123 disposed in the positioning seat 121, an eccentric wheel 126 disposed between the positioning seat 121 and the inner box 127, and a ratchet 128 disposed in the inner box 127. The first motor 122 has a first shaft 1221 inserted through the eccentric wheel 126 and the ratchet 128.

The positioning plate 123 has a recess 1232 receiving the eccentric wheel 126, and two oblong grooves 1231.

The outer box 124 has two oblong holes 1241 matching the oblong grooves 1231, an upper flange 1243 having a through hole 1242 receiving the joint 116, and four slide grooves 1244.

The inner box 127 has four slide rails 1271 inserted in the slide grooves 1244, a rectangular groove 1272, a through aperture 1273 matching the through hole 1242, and a liquid outlet 1274.

A cover plate 125 engages with the outer box 124. The cover plate 125 has a bubble outlet 1251.

The elevator box 14 is disposed on a bottom of the hollow casing 110. A base seat 141 is disposed in a rear portion of the elevator box 14. A main seat 142 is disposed in a front portion of the elevator box 14. The main seat 142 has a hollow housing 1422, and two circular holes 1420 receiving a first threaded sleeve 136 and a second threaded sleeve 156. The hollow housing 1422 has a center hole 1423, two inner grooves 1424, and a hollow chamber 1425. A cover panel 143 covers the main seat 142. The cover panel 143 has an opening 1431 receiving an annular seat 163.

Two longitudinal posts 140 pass through the rear portion of the elevator box 14. An upper end of each longitudinal post 140 is inserted in a bottom of the hollow casing 110.

A first hollow screw rod 135 is inserted through the first threaded sleeve 136. A first longitudinal pivot 130 is inserted through the first hollow screw rod 135. The first hollow screw rod 135 has a first outer thread 1351. The first threaded sleeve 136 has a first inner thread 1361. The first outer thread 1351 engages with the first inner thread 1361.

A second hollow screw rod 155 is inserted through the second threaded sleeve 156. A second longitudinal pivot 150 is inserted through the second hollow screw rod 155. The second hollow screw rod 155 has a second outer thread 1551. The second threaded sleeve 156 has a second inner thread 1561. The second outer thread 1551 engages with the second inner thread 1561.

An upper end of the first longitudinal pivot 130 is inserted in the bottom of the hollow casing 110. An upper end of the second longitudinal pivot 150 is inserted in the bottom of the hollow casing 110.

Two pairs of connection devices 1421 are disposed on the main seat 142 connected to the first hollow screw rod 135 and the second hollow screw rod 155.

The elevator drive mechanism 13 drives the elevator box 14 to move upward and downward. The elevator drive mechanism 13 has the first longitudinal pivot 130, a second motor 131 having a second shaft 1311, a first drive gear 132 receiving the a second shaft 1311, a first follower gear 133 engaging with the first drive gear 132, a first driven gear 134 engaging with the first follower gear 133, and the first driven gear 134 disposed on a top end of the first longitudinal pivot 130.

The back rubbing drive mechanism 15 drives the rubbing device 16 to rotate. The back rubbing drive mechanism 15 has the second longitudinal pivot 150, a third motor 151 having a third shaft 1511 a second drive gear 152 receiving the third shaft 1511, a second follower gear 153 engaging with the second drive gear 152, a second driven gear 154 engaging with the second follower gear 153, and the second driven gear 154 disposed on a top end of the second longitudinal pivot 150.

The rubbing device 16 is disposed in the elevator box 14. The rubbing device 16 has two driven pinions 1612, two gear wheels 1611 engaging with the second hollow screw rod 155, two follower shafts 161 connected to the respective driven pinion 1612 and the respective gear wheel 1611, two positioning racks 1610 disposed on the base seat 141 to support the follower shafts 161, a rotor device 162 having a threaded portion 1621 inserted through the center hole 1423 of the hollow housing 1422, a catch ring 1620, two catch blocks 1622, two compression springs 1623, and a push device 1624. The catch ring 1620, the catch blocks 1622, the compression springs 1623, and the push device 1624 are disposed in the hollow chamber 1425. The push device 1624 is clamped by the catch blocks 1622. Each catch block 1622 has an insertion groove 1625. An annular seat 163 is disposed on the rotor device 162. A foamed pad 1631 is inserted in the annular seat 163. The threaded portion 1621 of the rotor device 162 engages with the respective driven pinion 1612.

The adjustment device 17 is connected to the first longitudinal pivot 130, the second longitudinal pivot 150, and the longitudinal posts 140.

The adjustment device 17 has a seating panel 170, two positioning mounts 171, two screw posts 172, and two pinion sets 173.

Each of the positioning mounts 171 has a first blind hole 1712 receiving a lower end of the respective longitudinal post 140 and a second blind hole 1711 receiving a lower end of the respective longitudinal pivot 130 or 150.

Each of the screw posts 172 has a thread 1721. Each of the screw posts 172 encloses a lower portion of the respective longitudinal post 140.

Each of the pinion sets 173 has a rectangular box 1731 disposed on the respective screw post 172, a follower shaft 1732 disposed in the rectangular box 1731 and passing through a first pinion 1735 and a second pinion 1736, a driven shaft 1733 disposed in the rectangular box 1731, and the driven shaft 1733 having a threaded portion 1737 engaging with the first pinion 1735. The second pinion 1736 engages with the thread 1721 of the respective screw post 172. A handle 1734 is connected to one of the driven shafts 1733. The seating panel 170 is disposed between two rectangular boxes 1731.

It is an option to provide a first micromotion switch 137 disposed on the bottom of the hollow casing 110 and a second micromotion switch 174 disposed on one of the longitudinal posts 140 in order to control the second motor 131.

It is another option to provide a controller 18 to control the first valve 114, the second valve 113, the third valve 112, and the fourth valve 111.

Referring to FIGS. 1 to 12 again, the handle 1734 is operated in order to move the seating panel 170 upward and downward.

The fourth valve 111 is opened while the automatic back rubbing assembly of the present invention is not operated. Water flows from the water inlet pipe 1121 to the third connection pipe 1112, then to the water outlet pipe 1111, and then to the shower nozzle 1113.

The fourth valve 111 is closed while the automatic back rubbing assembly of the present invention is operated. The first valve 114, the second valve 113, the third valve 112, and the first motor 122 are actuated. Water flows from the water inlet pipe 1121 to the water outlet tube 1122 and the second connection pipe 1123.

When the first valve 114 is actuated to open, the liquid soap in the liquid soap tank 115 flows into the bubble producing device 12 via the first connection pipe 1141. The first motor 122 drives the eccentric wheel 126 and the ratchet 128 to rotate. The rotation of the ratchet 128 will produce bubbles. The bubbles will flow from the liquid outlet 1274 to the bubble outlet 1251.

When the second motor 131 rotates, the first longitudinal pivot 130 will rotate so that the elevator box 14 will move upward and downward.

When the third motor 151 rotates, the second longitudinal pivot 150 will rotate so that the follower shafts 161 will rotate also. The respective driven pinion 1612 will drive the respective threaded portion 1621 of the rotor device 162 to rotate. The foamed pad 1631 will rotate. When the back of the user contacts the foamed pad 1631, the foamed pad 1631 will rub the back of the user automatically.

The controller 18 can control the time period of the operation of the first valve 114, the second valve 113, the third valve 112, and the fourth valve 111.

When the controller 18 is operated, the fourth valve 111 is closed. After the first valve 114, the second valve 113, the third valve 112, and the first motor 122 are actuated for five seconds, the second motor 131 and the third motor 151 are actuated. Water flows from the water inlet pipe 1121 to the water outlet tube 1122 and the second connection pipe 1123. When the second motor 131 rotates, the first longitudinal pivot 130 will rotate so that the elevator box 14 will move upward and downward. When the third motor 151 rotates, the second longitudinal pivot 150 will rotate so that the follower shafts 161 will rotate also. The respective driven pinion 1612 will drive the respective threaded portion 1621 of the rotor device 162 to rotate. The foamed pad 1631 will rotate.

The second valve 113 will be closed fifteen seconds later. The first motor 122 will be closed sixty seconds later.

The third motor 151 can be controlled manually.

The invention is not limited to the above embodiment but various modification thereof may be made. Further, various changes in form and detail may be made without departing from the scope of the invention.

I claim:

1. An automatic back rubbing assembly comprising:

a hollow casing, a water control unit, a bubble producer, an elevator drive mechanism, an elevator box, a back rubbing drive mechanism, and a rubbing device, the bubble producer disposed in the hollow casing, the water control unit disposed in the hollow casing, the water control unit having a liquid soap tank, a joint connected to the bubble producer, a first valve, and a second valve, a first connection pipe connected to the liquid soap tank and the first valve, a second connection pipe connected to the second valve and a third valve, a water outlet tube connected to the third valve, a third connection pipe connected to the third valve and a fourth valve, and a water outlet pipe connected to the fourth valve and a shower nozzle, an water inlet pipe connected to the third valve, the water outlet tube having a water outlet, the bubble producer having a positioning seat disposed in a lower interior of the hollow casing, a slot formed on a top portion of the positioning seat, a first motor disposed on the positioning seat, an outer box disposed in the positioning seat, an inner box enclosed by the outer box, a positioning plate disposed in the positioning seat, an eccentric wheel disposed between the positioning seat and the inner box, and a ratchet disposed in the inner box, the first motor having a first shaft inserted through the eccentric wheel and the ratchet, the positioning plate having a recess receiving the eccentric wheel, and two oblong grooves, the outer box having two oblong holes matching the oblong grooves, an upper flange having a through hole receiving the joint, and four slide grooves, the inner box having four slide rails inserted in the slide grooves, a rectangular groove, a through aperture matching the through hole, and a liquid outlet, a cover plate engaging with the outer box, the cover plate having a bubble outlet, the elevator box disposed on a bottom of the hollow casing, a base seat disposed in a rear portion of the elevator box, a main seat disposed in a front portion of the elevator box, the main seat having a hollow housing, and two circular holes receiving a first threaded sleeve and a second threaded sleeve, the hollow housing having a center hole, two inner grooves, and a hollow chamber, a cover panel covering the main seat, the cover panel having an opening receiving an annular seat, two longitudinal posts passing through the rear portion of the elevator box, an upper end of each said longitudinal post inserted in a bottom of the hollow casing, a first hollow screw rod inserted through the first threaded sleeve, a first longitudinal pivot inserted through the first hollow screw rod, the first hollow screw rod having a first outer thread, the first threaded sleeve having a first inner thread, the first outer thread engaging with the first inner thread, a second hollow screw rod inserted through the second threaded sleeve, a second longitudinal pivot inserted through the second hollow screw rod, the second hollow screw rod having a second outer thread, the second threaded sleeve having a second inner thread, the second outer thread engaging with the second inner thread, an upper end of the first longitudinal pivot inserted in the bottom of the hollow casing, an upper end of the second longitudinal pivot inserted in the bottom of the hollow casing, the elevator drive mechanism driving the elevator box to move upward and downward, the elevator drive mechanism having the first longitudinal pivot, a second motor having a second shaft, a first drive gear receiving the second shaft, a first follower gear engaging with the first drive gear, a first driven gear engaging with the first follower gear, and the first driven gear disposed on a top end of the first longitudinal pivot, the back rubbing drive mechanism driving the rubbing device to rotate, the back rubbing drive mechanism having the second longitudinal pivot, a third motor having a third shaft, a second drive gear receiving the third shaft, a second follower gear engaging with the second drive gear, a second driven gear engaging with the second follower gear, and the second driven gear disposed on a top end of the second longitudinal pivot, the rubbing device disposed in the elevator box, the rubbing device having two driven pinions, two gear wheels engaging with the second hollow screw rod, two follower shafts connected to the respective driven pinion and the respective gear wheel, two positioning racks disposed on the base seat to support the follower shafts, a rotor device having a threaded portion inserted through the center hole of the hollow housing, a catch ring, two catch blocks, two compression springs, and a push device, the catch ring, the catch blocks, the compression springs, and the push device disposed in the hollow chamber, the push device clamped by the catch blocks, each said catch block having an insertion groove, an annular seat disposed on the rotor device, a foamed pad inserted in the annular seat, and the threaded portion of the rotor device engaging with the respective driven pinion.

2. The automatic back rubbing assembly as claimed in claim 1, wherein an adjustment device is connected to the first longitudinal pivot, the second longitudinal pivot, and the longitudinal posts.

3. The automatic back rubbing assembly as claimed in claim 2, wherein the adjustment device has a seating panel, two positioning mounts, two screw posts, and two pinion sets, each said positioning mount has a first blind hole receiving a lower end of the respective longitudinal post and a second blind hole receiving a lower end of the respective longitudinal pivot, each said screw post has a thread, each said screw post encloses a lower portion of the respective longitudinal post, each said pinion set has a rectangular box disposed on the respective screw post, a follower shaft disposed in the rectangular box and passing through a first pinion and a second pinion, a driven shaft disposed in the rectangular box, and the driven shaft having a threaded portion engaging with the first pinion, and the second pinion engages with the thread of the respective screw post.

* * * * *